United States Patent [19]

Monville et al.

[11] 4,137,702

[45] Feb. 6, 1979

[54] DOUBLE TORSION TWISTING MECHANISMS

[75] Inventors: Jean M. Monville, Paris; Jean Waleckx, Villebon-sur-Yvette, both of France

[73] Assignee: SKF Compagnie d'Applications Mecaniques, Clamart, France

[21] Appl. No.: 854,681

[22] Filed: Nov. 25, 1977

[30] Foreign Application Priority Data

Nov. 30, 1976 [FR] France ..... 76 36110

[51] Int. Cl.[2] ..... D01H 7/86

[52] U.S. Cl. ..... 57/58.74; 57/58.72

[58] Field of Search ..... 57/58.49, 58.72–58.76, 57/58.84, 58.83

[56] References Cited

U.S. PATENT DOCUMENTS

| | | | |
|---|---|---|---|
| 2,521,601 | 9/1950 | Planet | 57/58.72 |
| 2,873,570 | 2/1959 | Sage | 57/58.72 |
| 3,546,871 | 12/1970 | Ratti | 57/58.74 X |
| 3,788,055 | 1/1974 | Gabalda | 57/58.72 |
| 3,895,484 | 7/1975 | Greive et al. | 57/58.74 |

*Primary Examiner*—John Petrakes

*Attorney, Agent, or Firm*—Brisebois & Kruger

[57] ABSTRACT

The double torsion twisting mechanism includes a rotatable spindle which rotatably supports a bobbin. A coupling unit connected to the bobbin has its axis offset to the bobbin axis to prevent rotation of the bobbin. A yarn ballooning plate is secured to the spindle and rotates the coupling unit via a flexible membrane connected between the plate and the coupling unit. The flexible membrane is cut-out in the region of a radial yarn guide channel which rotates with the spindle.

8 Claims, 3 Drawing Figures

14
3
4
4a
II
19
22
8
29
24
23
25
II
21
11
20
17
13
12
16
15
2
5
6
9
1
10
7

III
20

27
19
24
18
30a
30b
17
I
29
30
14
I
19
30b
30a
16
27
19
III

DOUBLE TORSION TWISTING MECHANISMS

The invention concerns double torsion twisting mechanisms.

In conventional twisting machines, the yarn winds from a bobbin mounted on a co-axial bobbin-holder with a hollow spindle, then passes through the open end of the spindle and emerges below the bobbin through a radial yarn guide integral with the spindle, after which it passes towards a fixed yarn guide in an extension of the spindle axis to be wound on a receiving bobbin. Each spindle turn thus produces two twist turns of the yarn if the support of the bobbin is stationary in space. To fulfill this condition, it is not possible to use direct means of connection between this bobbin support and the structure in which the spindle rotates because the bobbin support is completely surrounded by the balloon of yarn which turns with the spindle.

In order to maintain the bobbin support stationary, it is known to use a mechanism with converging axes in which the bobbin support is rotatably mounted on the spindle, and the spindle rotates relative to a rigid support. In addition a unit is mounted for rotation about an axis disposed at a certain angle with respect to the axis of the spindle, this unit rotating in bearings in the bobbin support. The latter is thus immobilised because it cannot turn around both axes.

The unit is usually made of several parts fixed to each other and is of complex shape. One of these parts is pierced with a hole through which a lateral yarn guide channel of the spindle passes, the unit being able to turn around the oblique axis at the same time the spindle turns around its own axis. However to avoid jolts and vibrations pre-judicial to the mechanism at the great rotating speeds used for the spindle, it is necessary that the unit is driven by the spindle as homokinetically as possible. For this reason, classic homokinetic joints are not suitable by reason of their complexity, their space requirements, their high cost and the need to clear adequately the central passage of the spindle as well as the lateral passage of the yarn guide channel extending perpendicular to the spindle from the centre of the joint, i.e. from the junction of the two converging axes.

It is an object of the present invention to provide a twisting mechanism having drive means to the unit which is simple and economical as regards both cost and space.

According to the present invention we provide a double torsion twisting mechanism of the type comprising a unit rotatable in a fixed rotatable support of a hollow spindle and in a bobbin-holder rotatably mounted on the spindle, the unit being arranged to rotate in synchronism with the spindle and including a radial opening for the passage of a radial yarn guide channel extending from the spindle, the unit having an axis of rotation offset from that of the spindle and the drive means between the unit and the spindle comprising a flexible membrane which includes at least one central opening providing a passage for the spindle and which provides for the passage of the radial yarn guide channel by radial indentation or by axial displacement.

The radial yarn guide channel can be included in one of the arms of a rotating part fixed to the spindle and comprising two diametrically opposite arms, one of which carries a part annular formation in order to ensure at least three fixing points for a rotating plate of known type which facilitates the formation of a balloon of yarn. The flexible membrane is advantageously fixed by its periphery to the plate or between the plate and the rotating part with the aid of the same fixing parts as those used for the plate, while its central part, which is connected with the peripheral part by a wall of truncated conical shape when at rest, is fixed on a flange integral with the periphery of the coupler, this flange as well as the cylindrical wall of the coupler and also the wall of truncated cone shape of the flexible part being open in such a way as to permit the passage of the two arms of the rotating part. An opening in one direction gives it a C-shape or in two opposite directions gives it a double half-moon shape.

A preferred embodiment of the invention is hereinafter described with reference to the drawings, in which.

Figure 1:
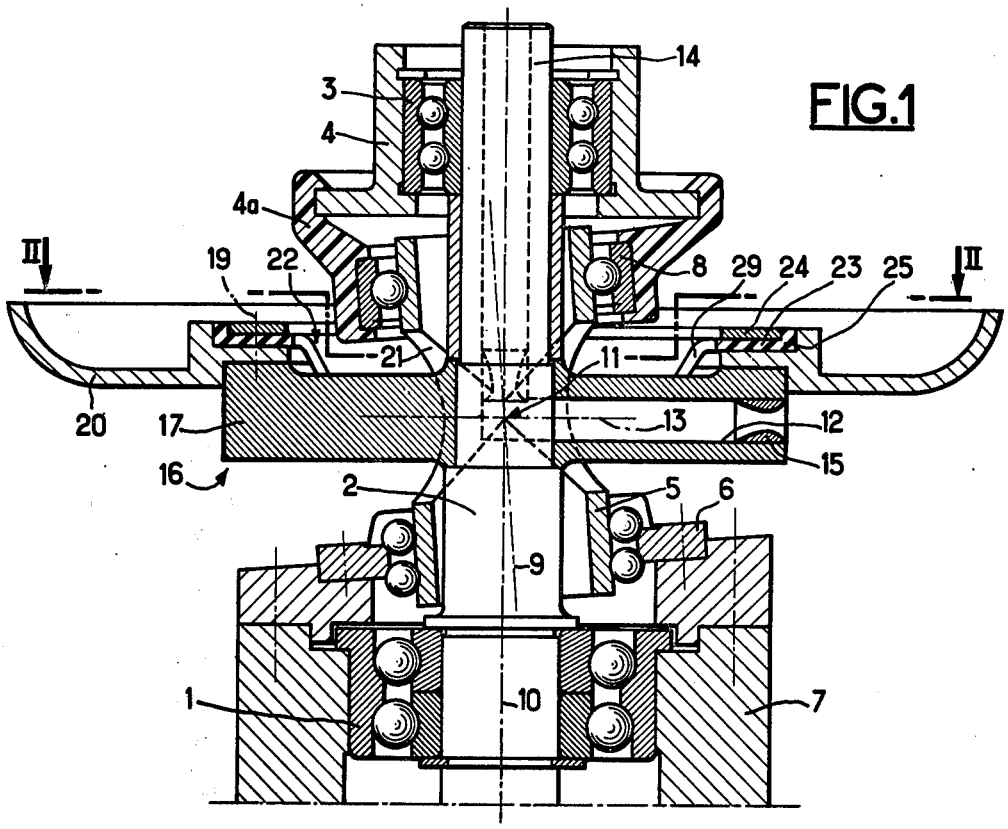
FIG. 1 is a view in section of the device taken through the plane containing the two converging axes.

The device comprises a fixed lower bearing block 1 for a rotatable hollow spindle 2 and an upper bearing block 3 in a bobbin-holder 4 which is to be maintained immobile in the space. A rotatable coupler 5 is of an essentially cylindrical shape, manufactured in a single piece, and mounted at its lower end in a rigid bearing block 6 having a double row of integral oblique contact balls similar to those of the bearing block 1.

The upper end of the coupler 5 rotates in another bearing block 8 with a single row of balls mounted in a housing **4*a* secured to the bobbin holder 4. It will be understood that the single bearing block 8** could be replaced by a bearing block of any other type.

The housing **4*a* is preferably manufactured of a sufficiently rigid material to maintain the off set relationship of the axes of rotation during operation so as to prevent rotation of the bobbin-holder 4 while allowing recovery of possible misalignment when assembling the unit. For example, the housing 4*a* could be manufactured of a plastic material which allows its assembly by a ratchet mechanism on the bobbin-holder 4. The coupler 5 and its bearing blocks 6 and 8 are arranged on an axis 9 which is off-set in relation to axis 10 of the spindle said axes intersecting at a point 11**.

A radial yarn guide channel 12 includes a passage arranged on an axis 13 contained in the plane of axes 9 and 10 and passing through the centre 11. This channel 12 is a perpendicular extension of the axial channel 14 formed in the upper part of the spindle 2.

Figure 2:
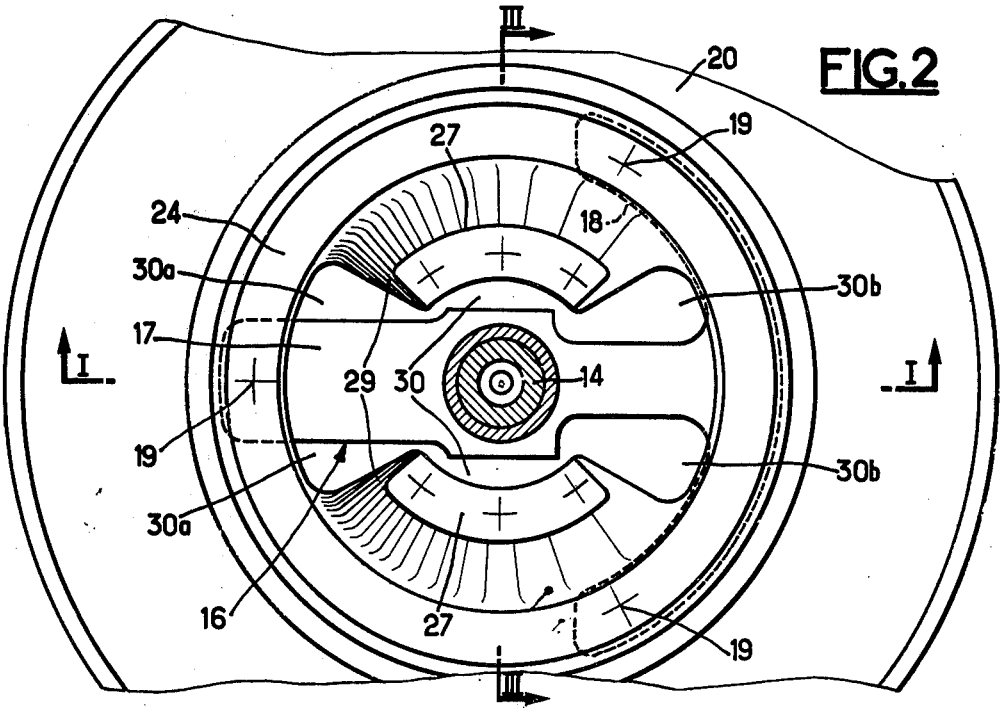
FIG. 2 is a view from above in section taken along line II—II of FIG. 1.

The radial yarn guide channel 12 is provided in one of the radial arms 15 of a central rotating part 16 comprising also a second radial arm 17 diametrically opposite the former, one of these two arms, preferably arm 15 being extended by a peripheral section 18 in the form of a part annulus as can be seen in FIG. 2. This provides at least three fastener fixing points, designated 19 in FIG. 2, for the support and fixing of a rotating plate 20 visible in FIGS. 1 and 3 and serving in the known way to facilitate the formation of the balloon of yarn. This plate is secured to and rotatable with the central rotating part 16 of the spindle 2 on which this latter is fixed.

The rotating coupler 5 is provided with two diametrically opposite openings 21 allowing passage of the two arms 15 and 17, the openings being sufficiently large to prevent contact despite the displacements of these parts relative to one another.

The driving of coupler 5 by the spindle 2, according to the invention, is achieved by a flexible membrane 22, with a thin wall, for example of rubber or other elastomer, the outer periphery 23 of which is fixed between the edge of the plate 20 and a peripheral ring 24 preferably by using the same fixing parts or fasteners as those used for fixing the plate to the rotating part 16. A peripheral edge 25 of the membrane 22 enables better centering in both directions of the latter to be achieved. As a variant this peripheral section 23 could be clamped between the plate 20 and the rotating part 16 and, if desired, with circular ring 24 between part 16 and plate 20.

It follows automatically from the arrangement shown that the plane of the peripheral section 23 of the flexible membrane 22 is of necessity axially spaced from centre point 11.

Figure 3:
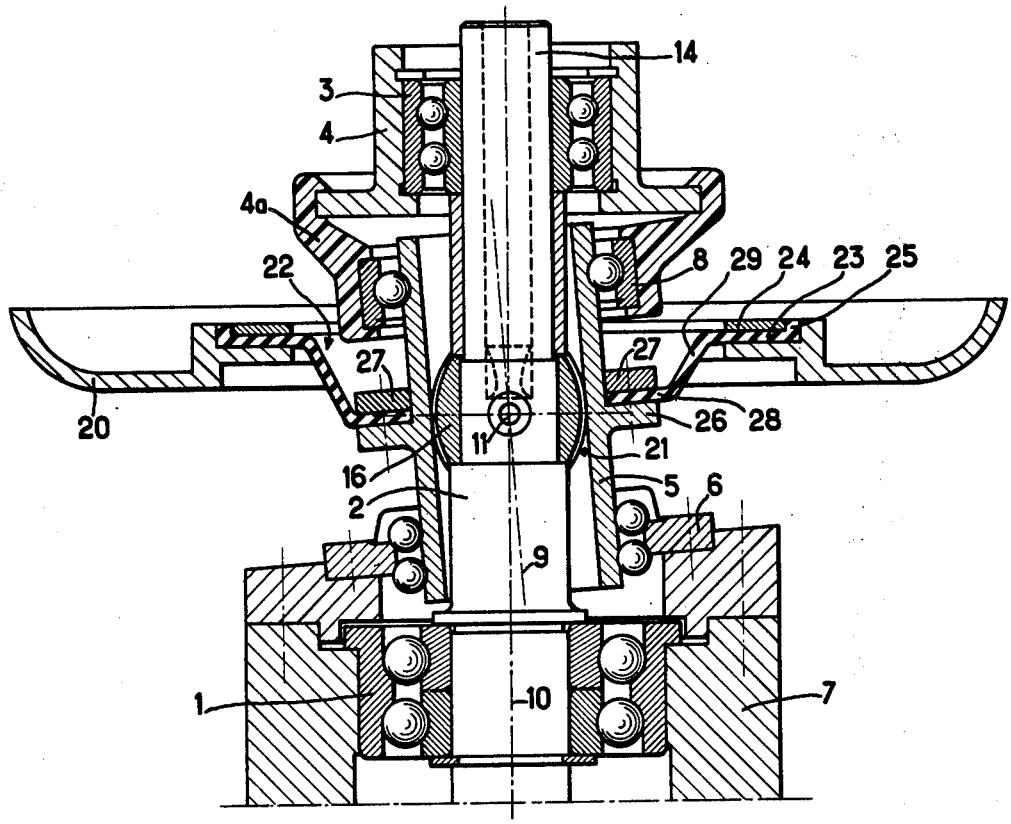
FIG. 3 is a view similar to FIG. 1 but after rotation by one quarter-turn of the spindle.

As can be seen in FIG. 3, the coupler 5 is provided with a flange 26 allowing fixing, between this flange and related parts 27, of the central section 28 of the flexible membrane 22. The plane of this central section 28 preferably passes through the centre 11 or only a short distance from it. The central sections 28 and the peripheral sections 23 are connected by a wall 29 which, when the part 16 is at rest, assumes the shape of the frustum of a cone of which the height is essentially equal to the distance between the centre 11 and the plane of the section 23.

The flange 26 is interrupted at the openings 21, thus requiring two distinct parts 27 to fix the central section of the flexible membrane to coupler 5. Moreover, this membrane, has a central opening 30 to allow the passage of coupler 5, and two diametrically opposite curved cut-outs 30a and 30b opening into the central opening 30, these cut-outs being such that they allow the passage without contact of the two arms 15 and 17 of the rotating part 16.

The drive to the coupler 5 is practically homokinetic, by virtue of the use of the membrane which undergoes a slight rotatory flexion of its conical section as represented particularly in FIG. 3 and which is a function of the small angle between axes 9 and 10. The device therefor ensures the desired drive without wear and tear, without noise and without excessive heating despite the great rotating speed of the spindle 2 and by means of parts of simple shape.

Although in the description the flexible membrane is fixed to the coupler by its central section, it will be understood that the reverse would be perfectly feasible, that is to say the peripheral section of the membrane may be fixed on the coupler which would then comprise a suitable flange with large diameter.

What we claim is:

1. A double torsion twisting mechanism comprising:

a hollow spindle rotatably mounted in a stationary support for rotation about a main axis, a rotating part secured to said hollow spindle, said rotating part having a radial yarn guide channel, a rotating plate secured to said rotating part, a bobbin-holder rotatably mounted on said spindle for rotation relative to the spindle about said main axis, a unit rotatably mounted on said support for rotation about an offset axis at an angle to said main axis, said unit being rotatably mounted on a housing of said bobbin-holder for rotation about said offset axis, a flexible membrane having an outer edge and a central opening defining an inner edge, said membrane being secured by its outer edge to said rotating plate and by its inner edge to said unit, said membrane including at least one radial passageway for said radial yarn guide channel.

2. A double torsion twisting mechanism according to claim 1 in which said inner edge of the flexible membrane is secured to said unit at a first level, said radial yarn guide channel is adjacent said first level, said outer edge is secured on said rotating plate at a second level axially spaced from the first level, and said radial passageway comprises an opening of said membrane extending from said first level to said second level and surrounding said yarn guide channel.

3. A mechanism according to claim 1, in which said unit comprises a coupler, said rotating part is anchor shaped and comprises two diametrically opposed arms, a part annular formation on one of said arms to provide at least three fixing points on said rotating part for securing said rotating plate to said rotating part, said rotating plate facilitating formation of a balloon of yarn, one of said arms being hollow and communicating with said hollow spindle to provide said radial yarn guide channel, the flexible membrane comprising a flat periphery fixed on said plate and a central flat section connected with the periphery by a wall of essentially truncated cone shape, said central flat section being fixed on a flange carried by the coupler adjacent the level of a centre of convergence of the axes and being interrupted at a location of passage of the two arms of the rotating part through two transverse openings of the coupler, said central section and said cone shaped wall having an opening allowing the longitudinal passage of the coupler and the spindle, and the transverse passage of the two arms of the rotating part.

4. A mechanism according to claim 3 wherein said flat periphery of the flexible membrane is fixed to said plate between said plate and said rotating part.

5. A mechanism according to claim 1, in which the radial yarn guide channel is in one of the arms of a rotating part fixed on the spindle and comprising two diametrically opposed arms one of which carries a part annular formation to provide on the rotating part at least three fixing points for the rotating plate, said plate facilitating the formation of the balloon of yarn, the flexible membrane comprising a flat periphery driven by said rotating part, and a flat central section fixed on a flange carried by a coupler of the unit near the level of a centre of convergence of the axes, said membrane being interrupted at two transverse openings of the coupler through which the two arms of the rotating part pass, said central section having an opening for the longitudinal passage of the coupler and the spindle, and said peripheral section of the membrane having at least one radial opening for the transverse passage of an arm including the radial yarn guide channel.

6. A mechanism according to claim 1 in which said unit comprises a rotating coupler of substantially cylindrical shape.

7. A mechanism according to claim 6, in which the coupler is mounted at its lower end in a rigid bearing block with two rows of rolling elements.

8. A mechanism according to claim 7 in which the coupler is mounted at its upper end in a bearing block, said bearing block being mounted in a housing capable of elastically accommodating alignment faults.

* * * * *